US005737957A

United States Patent [19]

Gray

[11] Patent Number: 5,737,957

[45] Date of Patent: Apr. 14, 1998

[54] APPARATUS FOR STRAIGHTENING A CYLINDRICAL MEMBER

[75] Inventor: Stanley J. Gray, Bixby, Okla.

[73] Assignee: Baker Hughes Incorporated, Houston, Tex.

[21] Appl. No.: 806,819

[22] Filed: Feb. 26, 1997

Related U.S. Application Data

[63] Continuation of Ser. No. 495,053, Jun. 26, 1995, abandoned.

[51] Int. Cl.[6] ..... B21D 37/16

[52] U.S. Cl. ..... 72/342.94; 72/342.94; 72/16.2; 72/17.3; 72/31.03; 219/121.37

[58] Field of Search ..... 72/14.8, 15.1, 72/15.3, 16.1, 16.2, 16.4, 17.3, 31.02, 31.03, 342.1, 342.5, 342.6, 342.94; 29/90.01; 11/900.7; 219/121.37, 121.38, 121.52, 121.59, 75

[56] References Cited

U.S. PATENT DOCUMENTS

| | | | |
|---|---|---|---|
| 1,060,365 | 4/1913 | Rowe . | |
| 2,205,783 | 6/1940 | Arutunoff . | |
| 2,428,825 | 10/1947 | Arnoldy | 72/342.5 |
| 2,433,055 | 12/1947 | Linden et al. . | |
| 2,874,265 | 5/1959 | Reed et al. | 219/121.37 |
| 3,866,447 | 2/1975 | Ritchie | 72/16.2 |
| 4,727,641 | 3/1988 | Kanatani et al. | 72/342.1 |
| 4,947,666 | 8/1990 | Hametner et al. | 72/16.4 |
| 5,182,073 | 1/1993 | Camacho | 219/121.37 |
| 5,204,506 | 4/1993 | Asmus et al. | 219/121.37 |
| 5,204,508 | 4/1993 | Camacho | 219/121.37 |
| 5,311,652 | 5/1994 | McConkey et al. | 29/90.7 |
| 5,354,963 | 10/1994 | Muller et al. | 219/121.37 |
| 5,443,201 | 8/1995 | Cartry | 228/119 |

OTHER PUBLICATIONS

"Plasmas for Joining, Cutting and Surfaces," L. O'Brien, WRC Bulletin, 131/Jul. 1968, pp. 1–19.

*Primary Examiner*—Lowell A. Larson
*Assistant Examiner*—Ed Tolan
*Attorney, Agent, or Firm*—James E. Bradley

[57] ABSTRACT

An apparatus for straightening a cylindrical member having an imperfection. An imperfection detector is used to locate the imperfection. A plasma arc torch is used to heat a portion of the cylindrical member in the vicinity of the imperfection. The plasma arc torch has an arc extending between an anode and an electrode. Gas flows past the arc and is heated, thus expanding into a plasma jet. The plasma arc torch directs the plasma jet toward the cylindrical member, thus heating a portion thereof. A quenching device is used to quench the heated portion of the cylindrical member, thus alleviating the imperfection. A control system automates the straightening process by monitoring the detector and controlling the heating and quenching based on information within a database. Peening or burnishing may be employed in lieu of the plasma arc torch.

17 Claims, 9 Drawing Sheets

APPARATUS FOR STRAIGHTENING A CYLINDRICAL MEMBER

This is a continuation of application Ser. No. 08/495,053, filed Jun. 26, 1995, now abandoned.

BACKGROUND OF THE INVENTION

1. Field of the Invention

This invention relates in general to an apparatus and method for straightening a cylindrical member and in particular to an automated apparatus which uses fast heating and quenching of a portion of the member to straighten it.

2. Description of the Prior Art

Applications for cylindrical members are virtually limitless. In several of the many applications, straightness of the cylindrical member is critical, such as where the clearance between the cylindrical member and another part is small. In such cases, even a slight bend in the cylindrical member can cause serious operational difficulties or failures. Removing slight ovality in tubular members is also sometimes a requirement. Before such cylindrical members can be used for their intended purpose, they must be checked for straightness. If the member is out of tolerance, it must be straightened.

For purposes of example, one specific application in which a cylindrical member must be extremely straight is in downhole electric motors. Downhole electric motors used in oil and gas operations are usually long and of relatively small diameter. Sometimes the motors are longer than thirty feet. The motors comprise a stator located within a stator housing, and a rotor which rotates within the stator. The clearance between the stator and the rotor is extremely small. In order for the rotor to freely turn within the stator, the stator must be extremely straight. However, due to deficiencies in the manufacturing processes, the stator assembly, comprising the stator and the stator housing, must be straightened prior to assembly with the rotor.

The available methods for straightening cylindrical members are relatively antiquated. Continuing to use stator assemblies as an example, prior to this invention, the methods used to straighten the stator assemblies were slow and inefficient. One commonly used method is to locate the imperfection, and to have a skilled artisan apply heat to the area of the imperfection using a gas torch, such as an oxyacetylene torch. The heated area is then quenched by application of wet rags, or water, to the heated area. The heating and subsequent quenching causes the heated and quenched metal to shrink. By selectively choosing the location of the heated area, the imperfections can be alleviated and the stator housing straightened. Other methods used to straighten stator housings include selective peening to remove the imperfection.

Manually heating and quenching the member, although used for many years is not completely satisfactory for several reasons. Because the heating and quenching are performed manually, there is no effective way of controlling the consistency of the heating and quenching. Since the amount of heat, location of the heat, heat sequences, and duration of the heat, together with the speed and length of the quenching are controlled by the worker, straightening the member becomes a highly skilled art which is hard to learn and pass on. Also, the quality and efficiency of the straightening varies from artisan to artisan.

A need exists for an apparatus and method of straightening cylindrical members that is fast, consistent, predictable, safe, cost-efficient, and easy to perform by even unskilled laborers.

SUMMARY OF THE INVENTION

It is the general object of the invention to provide an apparatus and method of straightening cylindrical members that is fast, consistent, predictable, safe, cost-efficient, and easy to perform by even unskilled laborers.

The apparatus of the present invention is an apparatus for straightening a cylindrical member having an imperfection. An imperfection detection means is used to detect the location of the imperfection. A plasma arc torch is used to heat a portion of the cylindrical member in the vicinity of the imperfection. The plasma arc torch has an arc extending between two electrodes. Gas flows past the arc and is heated, thus expanding into a plasma jet. The plasma arc torch directs the plasma jet toward the cylindrical member, thus heating a portion thereof. A quenching means is used to quench the heated portion of the cylindrical member, thus alleviating the imperfection.

The apparatus of the present invention also includes a control means for automating the straightening process. The control means includes a computer which stores information about the shape of member to be straightened. A measuring detector measures the shape of the member and transmits that information to the computer. The computer processes the information to control the location where heat is to be applied, the duration of the heat, and the duration of the quenching. Based on historical information, the computer preferably controls the plasma arc torch to alleviate only a portion of each imperfection detected on each pass and return on subsequent passes to complete the straightening process.

The straightening may also be performed by peening, either with projectiles or by delivering blows with a peening tool. Additionally, burnishing may be employed for straightening. The control system will control these methods also.

DETAILED DESCRIPTION OF THE INVENTION

Figure 1:
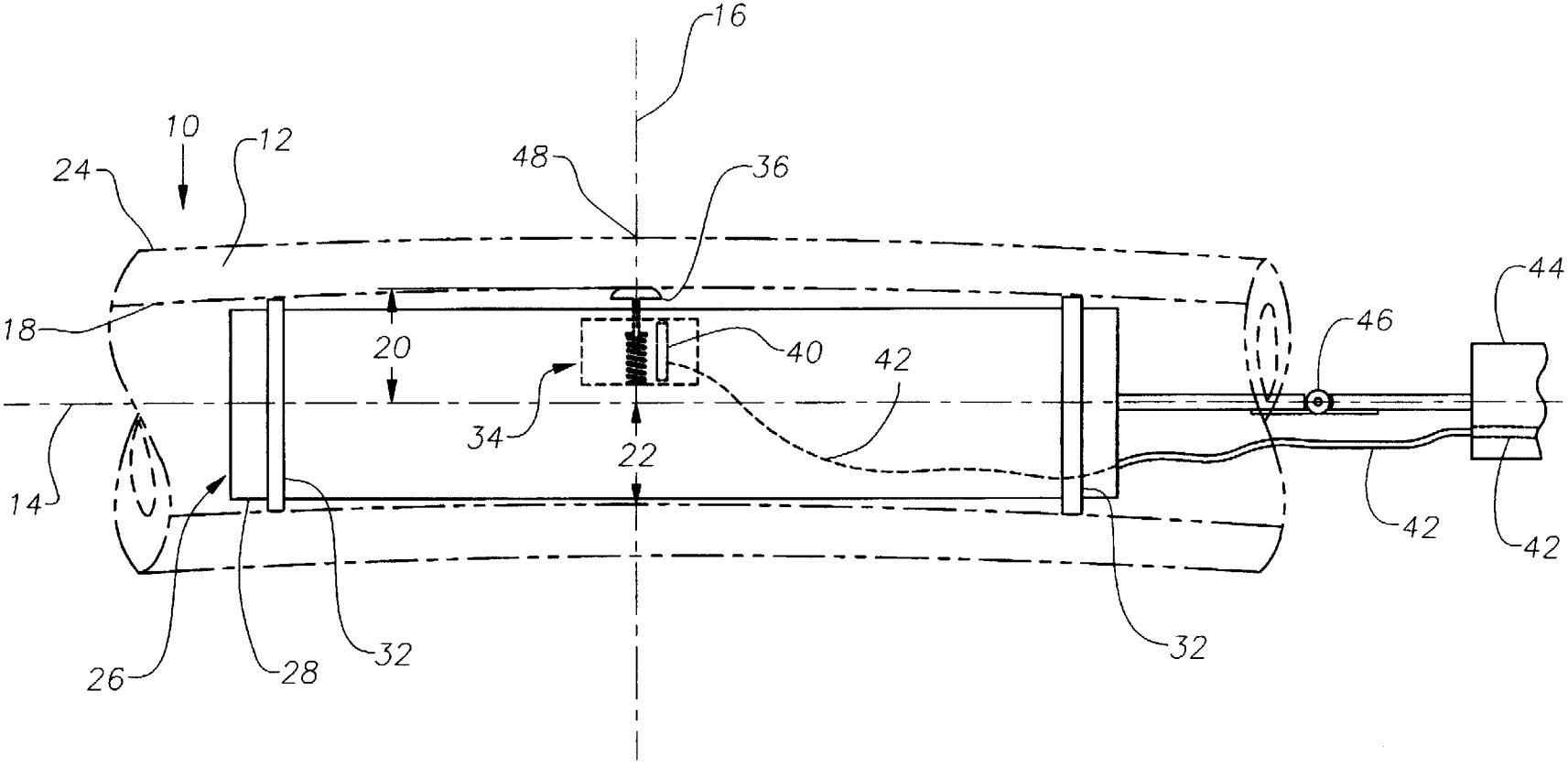
FIG. 1 is a schematic side view of the detection means used in conjunction with the apparatus of the present invention, shown located within a cylindrical member, the cylindrical member being shown in phantom.

FIG. 1 depicts, in phantom, a cylindrical member 10 which has geometric imperfections in its shape and needs to be straightened. Cylindrical member 10 could be any cylindrical member, such as a solid rod or tubular member. For discussion purposes, cylindrical member 10 is depicted as tubular member, or pipe, having a wall 12.

As shown in FIG. 1, pipe 10 is not straight. Centerline 14 is the centerline that would extend longitudinally through pipe 10 if pipe 10 were straight. Examining pipe 10 at perpendicular plane 16, it can be seen that the distance 20 from centerline 14 to the upper portion of inside surface 18 of pipe 10 is longer than the distance 22 from centerline 14 to the lower portion of inside surface 18. Due to the unstraightness, or imperfection, in pipe 10, the upper half of the exterior surface 24 of pipe 10 is convex in shape, while the lower half of exterior surface 24 is concave in shape. If the distances 20 and 22 are the same, then pipe 10 is straight at the location of plane 16. If the distances 20 and 22 are not the same, then that is an indication that pipe 10 is not straight at plane 16. The imperfection in pipe 10 shown in FIG. 1 is exaggerated for purposes of illustration. In real-life applications, the difference between distances 20 and 22 would usually be smaller than that depicted in FIG. 1.

FIG. 1 also shows an imperfection detection means, or measuring detector, 26. The type of imperfection detection means is not important as long as it can measure the straightness of the pipe and detect the location of the imperfections. The detector 26 shown in FIG. 1 comprises a cylindrical mandrel 28. Mandrel 28 has an outer diameter smaller than the inside diameter of pipe 10. At each end of mandrel 28 are centering pads 32. Centering pads 32 are connected to mandrel 28. Centering pads 32 have an outer diameter which is substantially equal, but slightly smaller than, the inner diameter of pipe 10. Centering pads 32 allow mandrel 28 to move within pipe 10, and serve to center the ends of mandrel 28 within pipe 10 so that probe assembly 34 can measure the straightness of inside surface 18 of pipe 10 between pads 32.

Probe assembly 34 is located within mandrel 28 and connected thereto by conventional means (not shown). Probe assembly 34 includes a probe 36. Probe 36 protrudes through mandrel 28 and is biased outwardly by biasing member 38. Sensing means 40 detects the radial displacement of probe 36 and sends a corresponding signal through wire 42 or by other transmission means. The displacement of probe 36 can be used as an indication of the distance between centerline 14 and inside surface 18 of pipe 10. Pipe 10 is rotated relative to probe assembly 34. If the probe readings are the same around the inner circumference of pipe 10 at a given plane such as plane 16, it is an indication that pipe 10 is straight at the location of plane 16. On the other hand, if the probe readings vary around the inner circumference of pipe 10 at a plane such as plane 16, it is an indication that pipe 10 is not straight at that location.

FIG. 1 also shows a means to move mandrel 28 within pipe 10. The means selected to move mandrel 28 is not critical as long as it allows mandrel 28 to be moved longitudinally and angularly with respect to pipe 10. In this embodiment, a mandrel push-rod 44 is used as a means to move mandrel 28. Push-rod 44 is fixedly connected to mandrel 28 by swivel means 46. Swivel means 46 prevents push-rod 44 from having to be exactly aligned with mandrel 28.

Probe readings can be taken along the entire inside surface 18 of pipe 10 to better determine the nature and location of the unstraightness, or imperfection, in pipe 10. The probe readings can also be used to identify the convex side of the imperfection. The convex side of the imperfection will be used herein to identify the location of the imperfection. For example, the imperfection depicted in FIG. 1 would be referred to as imperfection 48, and it would be described as being located on the upper portion of pipe 10 at plane 16, as indicated by numeral 48.

Figure 2:
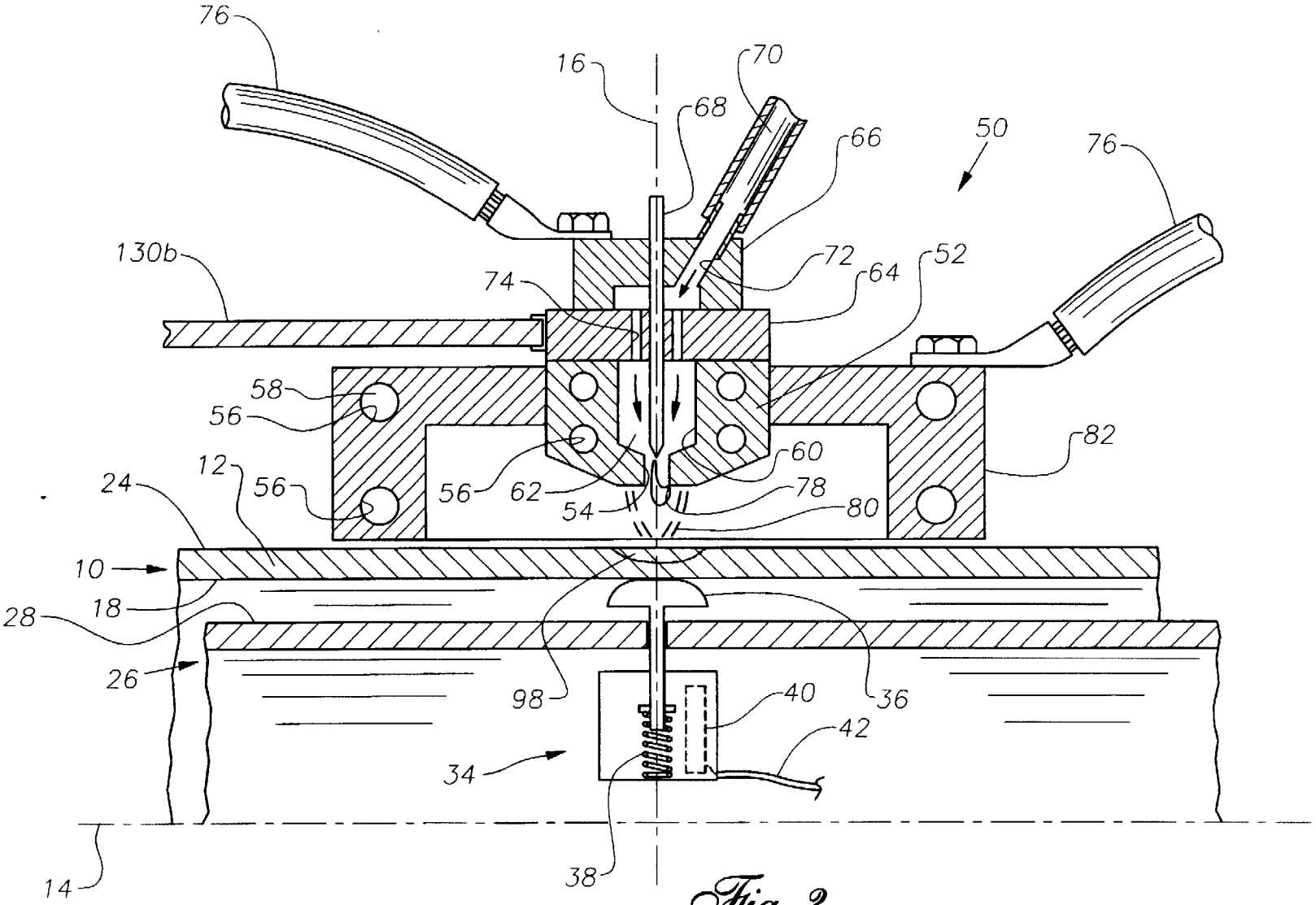
FIG. 2 is a schematic cross sectional view of the plasma arc torch of the present invention shown located on a cylindrical member within which is located on the detection means of the present invention.

Referring now to FIG. 2, a plasma arc torch 50 which is used in the present invention to alleviate imperfection 48 is shown. Torch 50 has an annular anode block 52 which serves as an electrode and also forms a nozzle 54. Electrode 52 has coolant passages 56 extending therethrough. Coolant 58 passes through coolant passages 56 and serves to cool electrode 52. The bore 60 extending through electrode 52 forms a plenum chamber 62. Plasma arc torch 50 is of the nontransferred arc type. Although transferred arc torches can transfer more energy to the work piece, they transfer too much energy for this particular application. Hence, in the preferred embodiment, torch 50 is of the nontransferred arc type.

An insulator block 64 is located above electrode 52 and electrically isolates electrode 52 from cathode block 66. An electrode 68 is in electric contact with cathode block 66 and is suspended within plenum chamber 62. Gas 70 is supplied through gas inlet 72. Gas 70 passes through openings 74 of insulator block 64 and enters plenum chamber 62. Conventional apparatus (not shown) provides electrical power to torch 50, by means of electrical leads 76, to form and sustain an arc 78. Preferably, arc 78 extends from electrode 68 to the electrode 52, and is not transferred to pipe 10. As gas 70 passes past arc 78 it is heated and expands into a superheated gas plasma 80. Nozzle 54 directs plasma 80 toward pipe 10.

A gas containment housing 82 surrounds torch 50 and extends between torch 50 and pipe 10. Gas trapped within gas containment housing 82 forms a gas shield between the portion of pipe 10 being heated and the atmosphere surrounding pipe 10.

Figure 3:
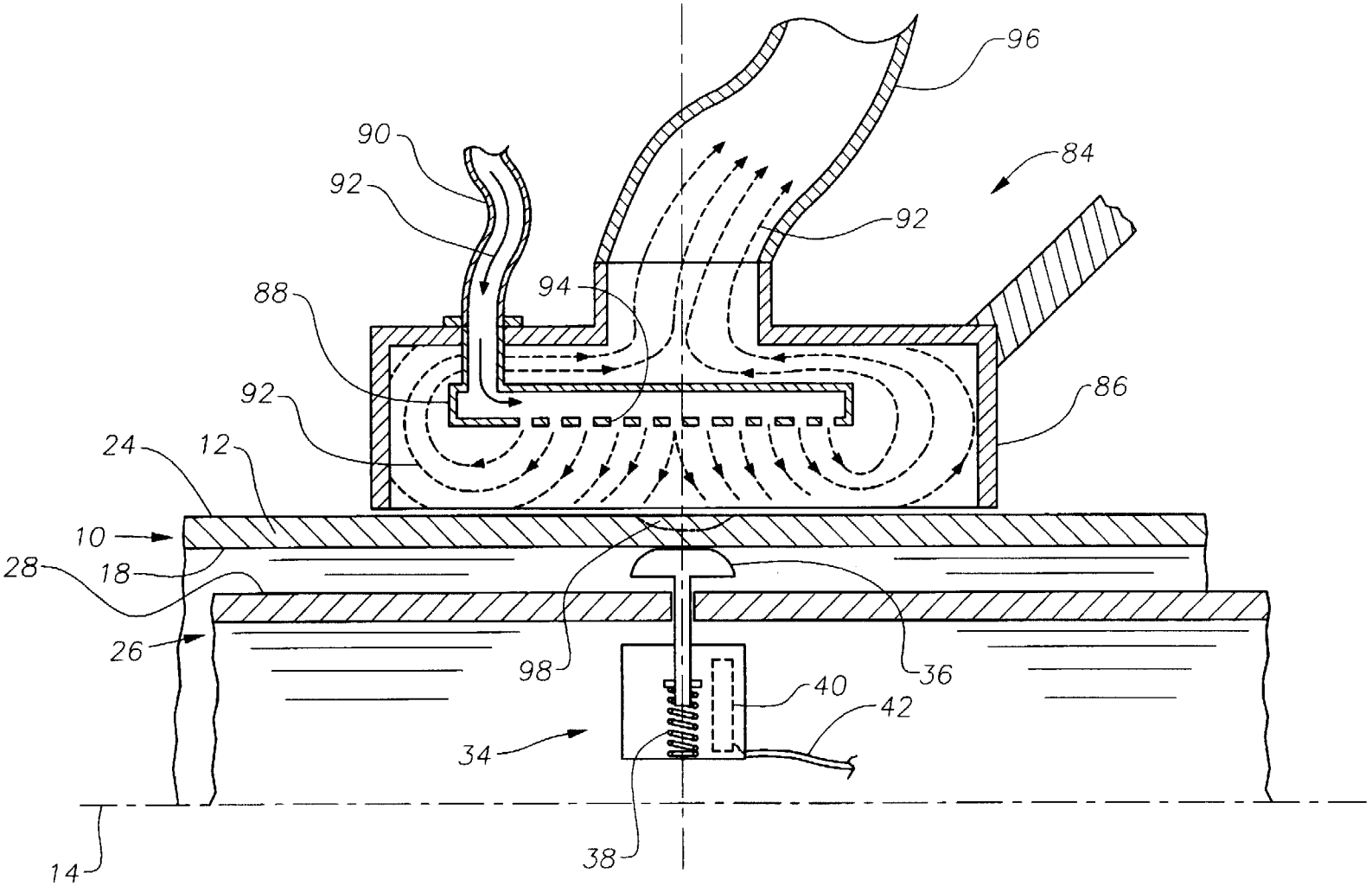
FIG. 3 is a cross sectional view for the quench head of the present invention shown located on a cylindrical member within which is located the detection means of the present invention.

Referring now to FIG. 3, a quench head 84 is shown. Quench head 84 comprises a quench head housing 86 which fits flush against pipe 10. Located within housing 86 is a spray head 88. Spray head 88 is connected to housing 86 and to quenching fluid supply line 90. Supply line 90 provides a quenching fluid 92, such as water, to spray head 88. Fluid 92 exits spray head 88 through holes 94 and is directed toward pipe 10. A vacuum line 96 is connected to housing 86 to suction quenching fluid 92 out of housing 86. The circulation of quenching fluid 92 over the portion of pipe 10 located below housing 86 cools that portion of pipe 10.

In operation, the apparatus of FIGS. 1–3 functions as follows to alleviate imperfection 48 shown in FIG. 1. Detector 26, is slowly moved through pipe 10 as pipe 10 is rotated to locate imperfection 48. Probe 36 and sensor 40 detect differences in the distances between centerline 14 and opposing points on inside surface 18 of pipe 10 to thus locate imperfection 48. Having located imperfection 48, plasma arc torch 50 is placed on the convex portion of imperfection 48. Electrical power is supplied to torch 50 through leads 76 so as to initiate and sustain arc 78 between electrode 68 and electrode 52. Gas 70 is supplied through gas inlet 72, as described above, and expands into plasma 80 which is directed toward pipe 10.

Plasma 80 is extremely hot, in the range of about 50,000 degrees fahrenheit. The extremely high heat of plasma 80 allows a very small area 98 to be heated. If a lower temperature heating device were used, such as the oxyacetylene torches used in the prior art, by the time a sufficiently high temperature is reached at outer surface 24, the heated area becomes very large. On the other hand, plasma arc torch 50 allows very rapid heating of only a small area 98. Due to the extremely high heat of plasma 80, the temperature gradient across wall 12 is very steep so that the temperature at outer surface 24 of pipe 10 is much higher than the temperature at inner surface 18 of pipe 10. Due to the heating of area 98, wall 12 at area 98 expands.

Torch 50 heats pipe 10 until outer surface 24 at area 98 reaches a temperature of about 1500 degrees Fahrenheit. Due to the steep temperature gradient across wall 12, the temperature at inner surface 18 will still be low. A low temperature at inner surface 18 is desirable because higher temperatures can create a dimple, thereby interfering with the straightness of inside surface 18 of pipe 10.

As soon as area 98 is sufficiently heated, as described above, torch 50 is shut off and immediately raised away from pipe 10 so that quench head 84 can be placed over heated area 98. Quench head 84 circulates quenching fluid 92 over heated area 98 so as to rapidly quench heated area 98. The quenching of heated area 98 causes wall 12 at area 98 to shrink more than it expanded due to the heating. The overall shrinking of area 98 of wall 10 causes pipe 10 to bend slightly, in the direction opposite the original bend, alleviating the convex shape of pipe 10 at imperfection 48. Thus, imperfection 48 is alleviated.

The apparatus of FIGS. 1–3 can be operated manually by manually operating detector 26, torch 50, and quench head 84. Although this would result in a great improvement over the prior art because of the extremely high heat produced by the plasma gas torch as compared to the heat generated by other types of torches generally used by the prior art for this type of application, the apparatus of FIG. 4 represents a further improvement contemplated by this invention.

Figure 4:
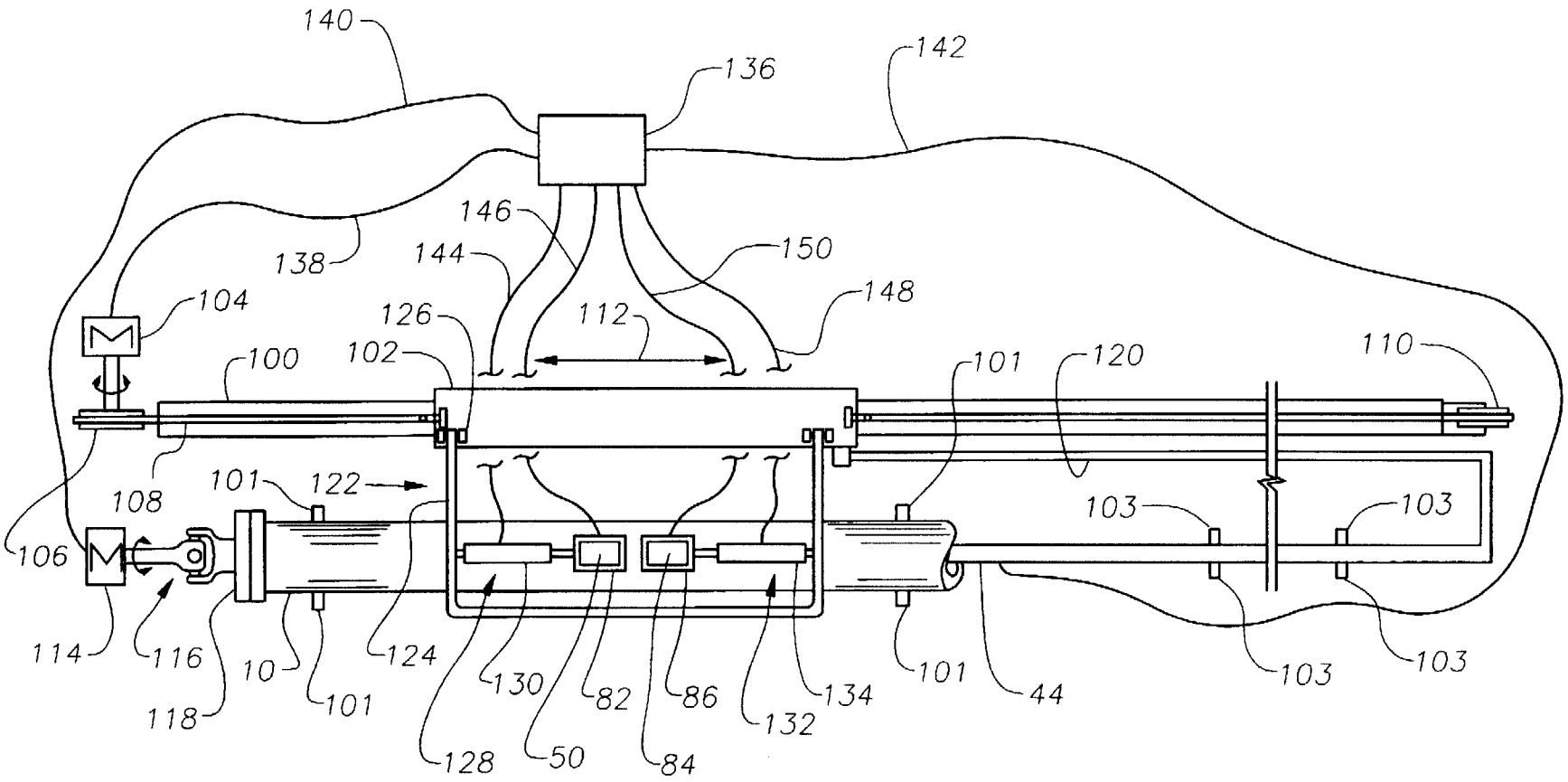
FIG. 4 is a top view schematic representation of the apparatus of the present invention.

Referring now mainly to FIG. 4, a top view of an automated straightening apparatus for cylindrical members is shown. A track 100 extends longitudinally and supports a carriage 102. Carriage 102 is coupled to track 100 so as to allow carriage 102 to slide or roll along track 100. A motor 104 is located at one end of track 100 and is connected to a drive wheel 106 which engages a chain 108, which may also be a cable or other means. At the opposite end of track 100 is an idle wheel 110 which also engages chain 108. One end of chain 108 is connected to one end of carriage 102 and extends around drive wheel 106, below track 100, around idle wheel 110, and is connected to the other end of carriage 102. By selectively operating motor 104, carriage 102 can be moved longitudinally along track 100 in the direction of arrow 112.

The cylindrical member 10 to be straightened is located parallel to track 100. For purposes of illustration, cylindrical member 10 is depicted as a pipe. Pipe 10 is supported by rollers 101. A motor 114 is connected to pipe 10 by U-joint 116 and fastening means 118. Motor 114 can be selectively operated to rotate pipe 10 around its longitudinal axis.

Referring still to FIG. 4, connected to mandrel push rod 44, and located within pipe 10, is detector 26 (hidden from view in FIG. 4) like the similarly numbered detector of FIG. 1. Mandrel push rod 44 is connected to carriage 102 by connecting push rod 120. Rollers 103 support mandrel push-rod 44. As carriage 102 moves longitudinally along track 100, detector 26 is likewise moved longitudinally within pipe 10. The longitudinal movement of detector 26 caused by motor 104, combined with the rotation of pipe 10 caused by motor 114, allows probe 36 of detector 26 to measure the entire inner surface 18 of pipe 10.

Figure 5:
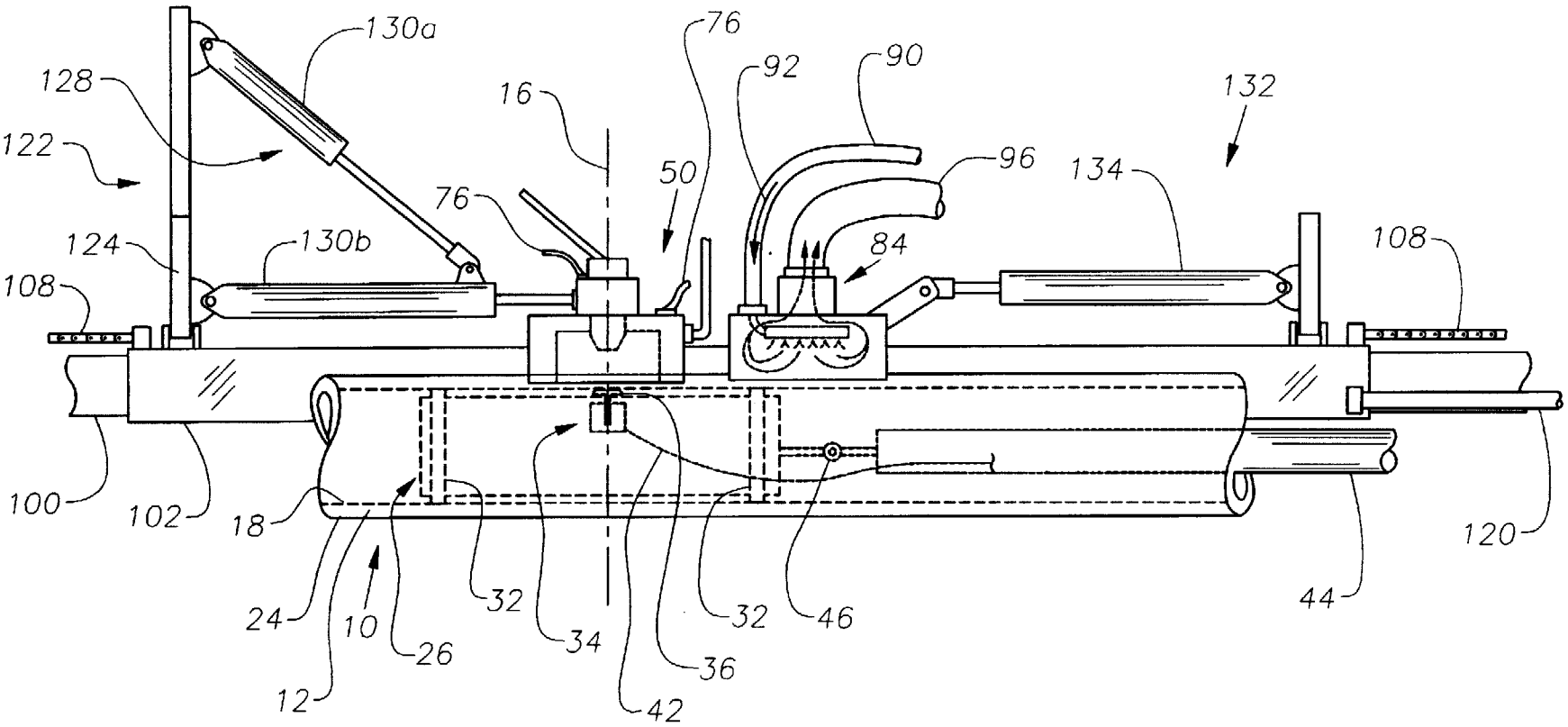
FIG. 5 is a side view schematic representation of part of the apparatus of the present invention, with the plasma arc torch shown over the imperfection.

Referring now to FIGS. 4 and 5, pivotally connected to carriage 102 is a head assembly 122. Head assembly 122 comprises a frame 124 which is pivotally connected to carriage 102 by means of pivoting means 126. Torch positioning mechanism 128 is connected to frame 124 at one end, and to plasma arc torch 50 at the other end. Plasma arc torch 50 of FIG. 4 is the same as the similarly numbered torch of FIG. 2.

Torch positioning mechanism 128 can be any type of mechanism which can move torch 50 as desired. In this embodiment it comprises air cylinders **130*a*, 130*b* which can be selectively controlled to move torch 50. Cylinders 130*a*, 130*b* are schematically shown in FIGS. 4 and 5**, with the necessary air inlets and outlets not shown for purposes of clarity.

Also mounted to frame 124 is a quench head positioning mechanism 132. One end of quench head position mechanism 132 is connected to frame 124, and the other end is connected to quench head 84. Quench head 84 of FIG. 4 is the same as the similarly numbered quench head of FIG. 3. Quench head positioning means 132 can be any type of mechanism which can move quench head 84 as desired. In this embodiment it comprises air cylinder 134 which can be selectively controlled to move quench head 84. Cylinder 134 is schematically shown in FIGS. 4 and 5, with the necessary air inlets and outlets not shown for purposes of clarity.

Referring now mainly to FIG. 4, a control means, or system, 136 is schematically shown. In the present embodiment, control means 136 comprises a computer. Computer 136 is connected to motor 104, as schematically represented by line 138, so that it can control the movement of carriage 102 and detector 26. Computer 136 is also connected to motor 114, as schematically represented by line 140, so that it can control the operation of motor 114 and hence the rotation of pipe 10. Computer 136 is also connected to detector 26 so that it can receive the readings obtained by detector 26. This connection is schematically illustrated by line 142 extending from computer 136 to push rod 44 within which is located wire 42 by means of which the probe readings are transmitted (see FIG. 1). As further shown in FIG. 4, computer 136 is also connected to torch positioning mechanism 128 as schematically illustrated by line 144. Through this connection, computer 136 can control the movement of torch 50. Line 146 schematically represents the connection between computer 136 and torch 50 that allows computer 136 to control the amount of heat and the duration of the heat generated by torch 50.

As still further shown in FIG. 4, line 148 schematically represents the connection between computer 136 and quench head positioning means 132 which allows computer 136 to control the movement of quench head 84. Schematically represented by line 150 is the connection between computer 136 and quench head 84 that allows computer 136 to control the duration of the quenching performed by quench head 84.

Figure 6:
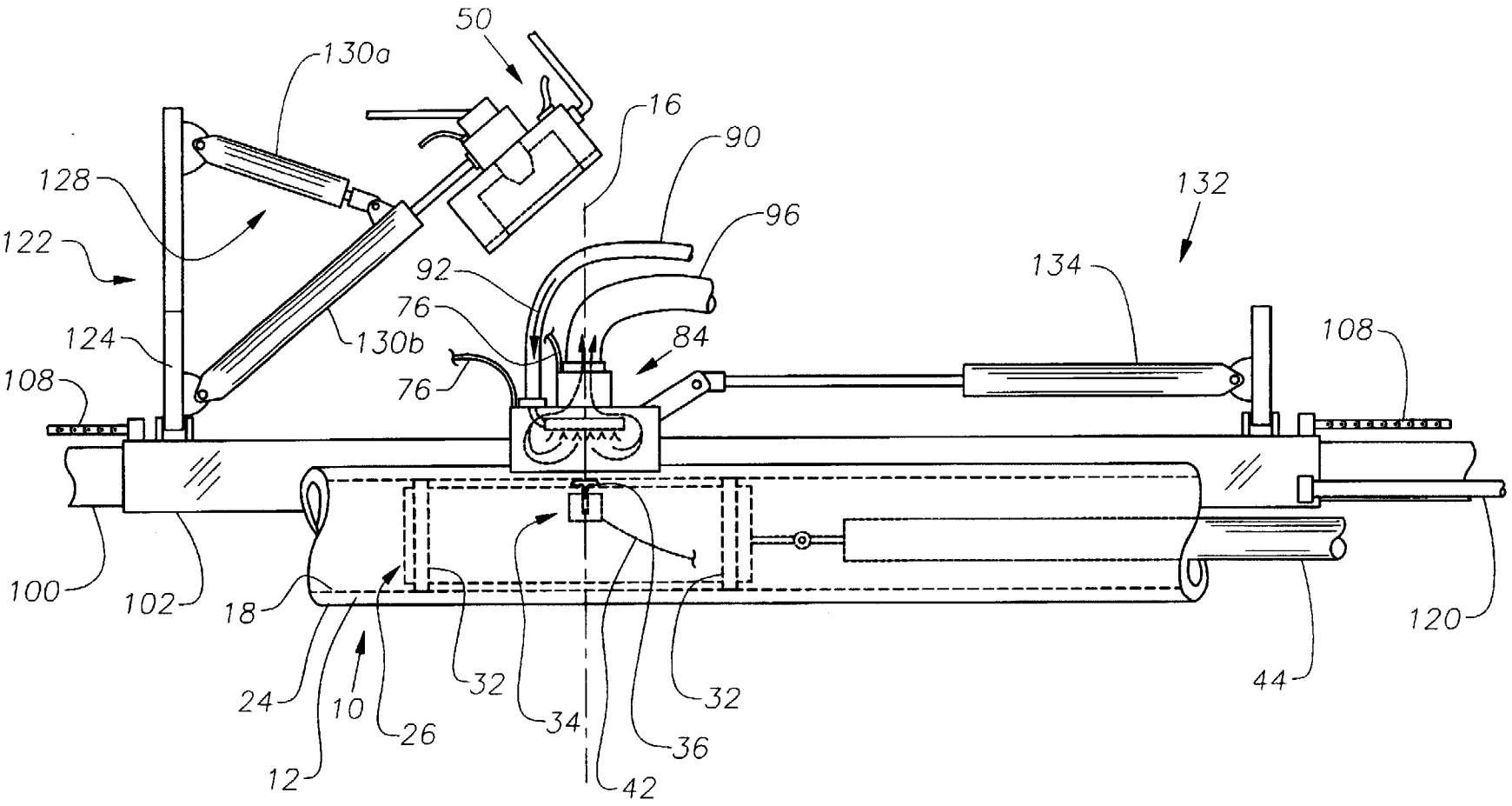
FIG. 6 is a side view schematic representation of part of the apparatus of the present invention, with the plasma arc torch shown in the raised position and the quench head shown over the heated area.
Figure 7:
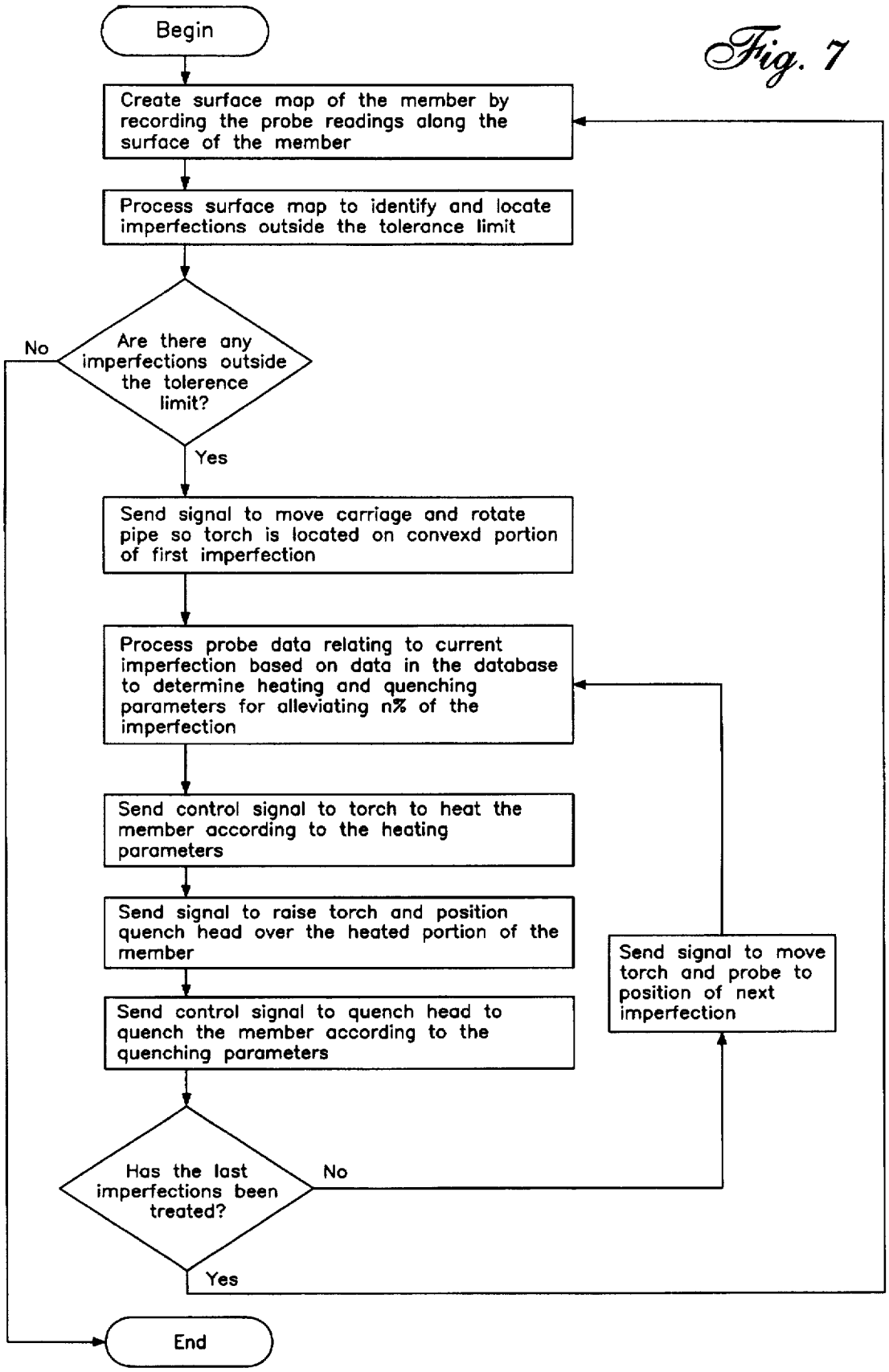
FIG. 7 is a flow chart illustrating the operation of the apparatus of the present invention.

In operation, the apparatus of FIG. 4 functions as further shown in FIGS. 5 and 6 and as illustrated in the flow chart of FIG. 7. Referring first mainly to FIG. 4, pipe 10 is positioned parallel to track 100 and is connected to motor 114. Head assembly 122 is pivoted about pivot means 126 and lowered toward pipe 10 so that torch 50 and quench head 84 contact pipe 10. Computer 136 sends the appropriate control signals to motors 104 and 114 to rotate pipe 10 and move carriage 102 so that probe 36 of detector 26 can take readings along the entire inner surface 18 of pipe 10. As detector 26 is taking readings along inner surface 18, computer 136 receives data from detector 26 and stores such data, essentially comprising a map of inner surface 18, for later processing.

Once probe 36 of detector 26 has taken readings along the entire inner surface 18, and the map of inner surface 18 is complete, computer 136 processes the data received from detector 26. The data from detector 26 is first processed to identify and locate any imperfections outside a predetermined tolerance limit. If any imperfections exists outside the tolerance limit, computer 136 sends the appropriate control signals to motors 104 and 114 to move carriage 102 and rotate pipe 10 so that torch 50 is positioned on the convex portion of imperfection 48.

Computer 136 then processes the probe data based on pre-existing data in a database. The database contains information compiled from past usages of the apparatus. The database contains information regarding the amount of heat, duration of heat, and duration of quenching that was applied to members of given thicknesses and the amount of alleviation of the imperfection that was achieved. Computer 136 can process the probe readings from the current imperfection based on the database and select appropriate heating and quenching parameters for the current application.

Referring now mainly to FIG. 5, once computer 136 has selected the appropriate heating and quenching parameters, it sends the appropriate control signals to torch 50. At this point, torch 50 is located in the heating position, on the convex side of imperfection 48. The heat from torch 50 rapidly heats wall 12 of pipe 10. As described above, because of the extremely high temperature of plasma 80, only a small, localized area 98 of pipe 10 is heated. Air cylinder **130*b* causes torch 50 to reciprocate longitudinally along pipe 10 a distance of about ¾ inch at a rate of about one second per stroke. This reciprocating motion creates an elongated heated area 98 and helps to increase the amount of straightening which will occur. The length of the stroke can be controlled to increase or decrease the amount of straightening which will occur. Computer 136** controls the amount of heating, including intensity of the heat, duration of the heat, and the shape of the heated area.

Referring now mainly to FIG. 6, once torch 50 has completed the heating of heated area 98, computer 136 sends the appropriate signals to torch positioning mechanism 128, and in particular air cylinder **130*a*, to raise torch 50 to the retracted position. Computer 136 also sends the appropriate signals to quench head positioning mechanism 132, and in particular air cylinder 134, to move quench head 84 from the retracted position to the quenching position over heated area 98. Once quench 84 is located over heated area 84, computer 136 sends the appropriate signals to begin the quenching process. Computer 136 controls the amount of quenching by controlling the amount of quenching fluid 92, and the amount of time that quenching fluid 92 is circulated over pipe 10. Once the quenching process is complete, computer 136 causes quench head positioning mechanism 132 to retract quench head 84 and lower torch 50** back to the position of FIG. 5.

Once a particular imperfection has been alleviated, computer 136 sends the appropriate control signals to move torch 50 and detector 26 to the location of the next imperfection to be treated. Computer 136 repeats the steps described above to treat the current imperfection. Once all the imperfections have been alleviated, computer 136 causes another surface map of the pipe to be created. If there still are imperfections outside the tolerance limit, computer 136 repeats the entire process described above of treating each imperfection that exceeds the selected tolerance limit. Computer 136 repeats this process until there are no imperfections outside the tolerance limit.

In the present embodiment, computer 136 is programmed to select heating and quenching parameters to alleviate only about 60% of each imperfection. The reason for alleviating only a fraction of each imperfection is that if there are several imperfections along pipe 10, the straightening of one imperfection can affect another of the imperfections. Thus, it is desirable to alleviate only about 60% of each imperfection on the first pass. Once all the imperfections are alleviated by about 60%, then a second map of pipe 10 is taken, and the procedure is repeated until there are no more imperfections outside the tolerance limit, as described above.

Figure 8:
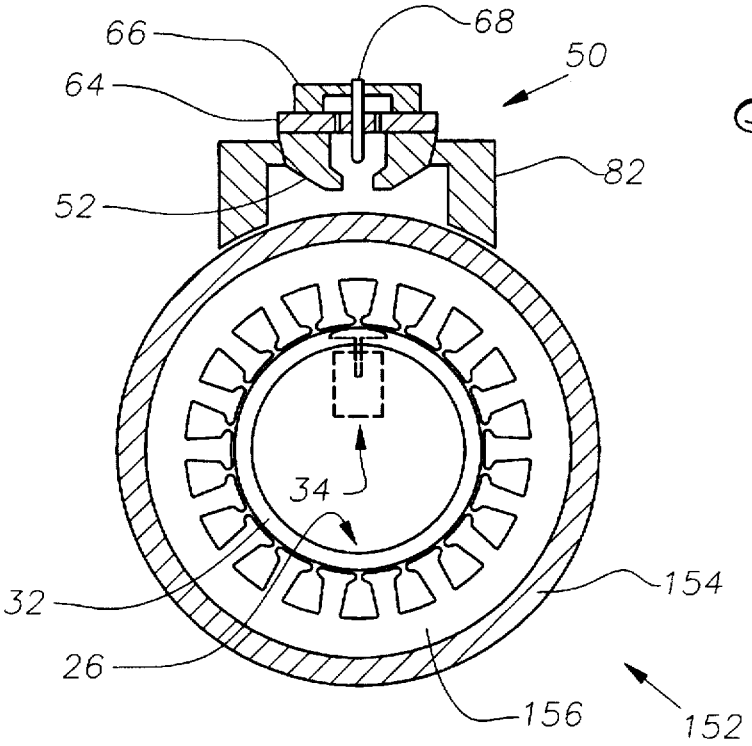
FIG. 8 is cross sectional view of a particular type of cylindrical member which can be straightened with the apparatus of the present invention.

FIG. 8 illustrates a cylindrical member for which the present invention can be used. The cylindrical member shown in FIG. 8 is a stator assembly 152 of a downhole electric motor. Stator assembly 152 comprises stator housing 154 and stator 156. Stator assembly 152 can be straightened by the same methods as described above in FIGS. 1–7.

Figure 9:
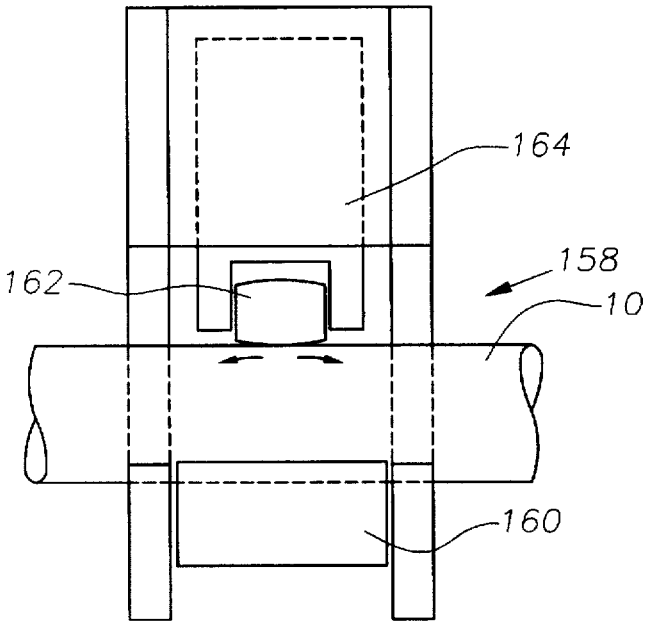
FIG. 9 is a schematic front view illustrating a burnishing tool for straightening a cylindrical member.
Figure 10:
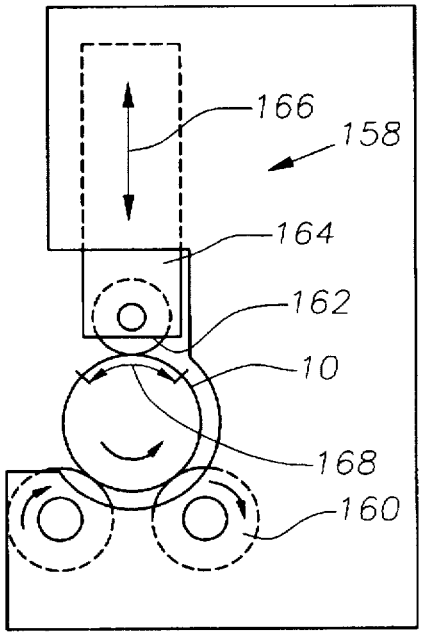
FIG. 10 is a schematic side view of the burnishing tool of FIG. 9.

Referring to FIGS. 9 and 10, an alternate straightening device 158 to the plasma arc torch previously described is shown. Burnishing tool 158 has lower rollers 160 which rotatably support cylindrical member 10. An upper burnishing roller 162 is located on an opposite side from support rollers 160. Burnishing roller 162 is preferably of less width than support rollers 160 and has a slightly convex sidewall, rather than cylindrical. This shape provides a smaller surface area in contact with member 10 than support rollers 160. A hydraulic press 164 moves burnishing roller 162 upward and downward, as indicated by arrows 166. Press 164 will apply a downward force of selected magnitude against a portion of the surface of member 10 as member 10 is rotated back and forth by driving either support rollers 160 or burnishing roller 162. This burnishes an area 168, spreading the area 168 to straighten member 10. The control system previously described in connection with the embodiment of FIGS. 1–8, including the measuring detector and computer, will be employed to control the location of the area to burnish as well as the duration and force to be applied by press 164.

Figure 11:
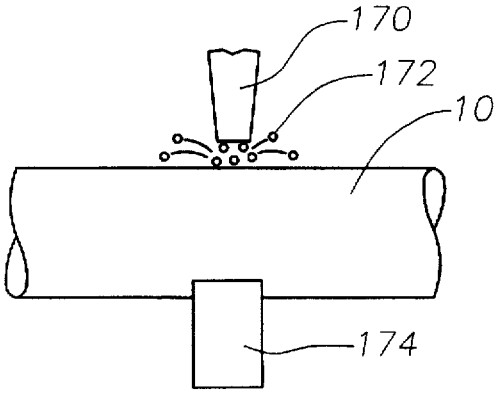
FIG. 11 is a schematic front view illustrating peening equipment for straightening a cylindrical member by propelling projectiles against portions of the member.
Figure 12:
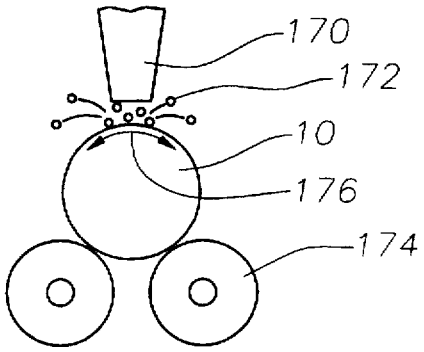
FIG. 12 is a schematic side view of the peening equipment of FIG. 11.

FIGS. 11 and 12 illustrate another method for altering the shape of a member 10 to straighten it. The method includes a peening gun 170 which has a nozzle and means for propelling shot projectiles 172 against a selected area. The member 10 is supported on rollers 174. Rollers 174 may be driven back and forth to reciprocally rotate member 10 to control the peened area 176. As shown in FIG. 12, this operation deforms slightly an area 176 to alleviate imperfections in the straightness of member 10.

Figure 13:
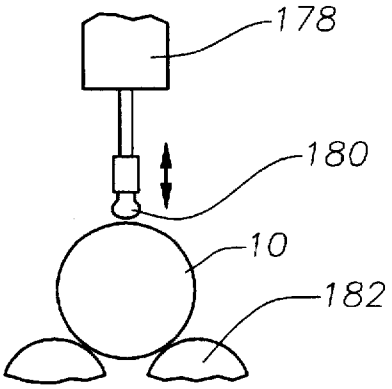
FIG. 13 is a schematic side view of peening equipment for straightening a member by delivering blows with a peening tool.

FIG. 13 illustrates another method of peening a member 10 to alleviate imperfections in straightness. The method employs a peening hammer 178 which delivers blows against member 10 by reciprocating a peening tool 180. Rollers 182 will rotatably reciprocate member 10 during the peening operation. The control system previously described in connection with the embodiment of FIGS. 1–8, including the measuring detector and computer, will be employed to control the location of the area to peen as well as the duration of peening for the peening methods of FIGS. 11–13.

The apparatus of the present invention represents a major improvement over the prior art. The use of a plasma arc torch to heat the area of the imperfection results in a steep temperature gradient through the cylindrical member. The steep temperature gradient allows the outer surface of the cylindrical member to be heated to higher temperatures without overheating the interior portions of the cylindrical member.

The automation of the entire straightening process represents a further improvement over the prior art. By automating the process, greater consistency in the heating and quenching is achieved. Also, because the entire process is automated, the need of skilled artisans is obviated. Furthermore, because the process is automated, there is no need for humans to be near the apparatus while it is in operation, thus increasing the safety of the process. This is particularly important when a plasma arc torch is used, because of the increased dangers associated with the use of a plasm arc torch.

The automation of the straightening process also allows the apparatus to have a "learning" feature. Each time the apparatus performs a straightening operation, it can record the results for use in future straightening operations. The apparatus can be programmed to use the data so acquired to improve and maximize its operation. Thus, the apparatus can learn how various types of cylindrical members react to the straightening process, and can adjust its heating and quenching parameters accordingly. Also, the apparatus can learn how to adjust the heating and quenching parameters to account for different amounts of unstraightness in the cylindrical member, and to account for different numbers and locations of imperfections.

While the invention has been particularly shown and described with reference to four embodiments, it will be understood by those skilled in the art that various changes in form and detail may be made therein without departing from the spirit and scope of the invention. Also, the correcting of shapes by using the equipment shown can also be performed on members other than electrical submersible pump motor housings.

What is claimed is:

1. An apparatus for geometrically modifying a tubular member having a bore and having a dimensional imperfection, the apparatus comprising in combination:

an imperfection detector that inserts into the bore for detecting the general location of the imperfection;

a plasma arc torch having an arc extending between electrodes and gas flowing past the arc, wherein the gas is heated and expands into a plasma jet, for directing the plasma jet toward the member for heating a portion of the member so as to correct the imperfection; and wherein the imperfection detector comprises:

a mandrel which has a diameter smaller than the bore of the member to allow insertion into the bore;

a centralizer for centering the mandrel within the member; and a probe mounted to the mandrel for measuring concentricity of the bore of the member by comparing the distances from the centerline of the member to adjacent portions of an interior surface of the bore.

2. An apparatus for straightening an elongate member having a dimensional imperfection, the apparatus comprising in combination:

an imperfection detector for detecting the general location of the imperfection; and a plasma arc torch having an arc extending between electrodes and gas flowing past the arc, wherein the gas is heated and expands into a plasma jet, for directing the plasma jet toward the member for heating a portion of the member so as to correct the imperfection; and a carriage for moving the plasma arc torch longitudinally along the member, and for moving the plasma arc torch between a heating position and a retracted position.

3. An apparatus for geometrically modifying a member having a dimensional imperfection, the apparatus comprising in combination:

an imperfection detector for detecting the general location of the imperfection;

a plasma arc torch having an arc extending between electrodes and gas flowing past the arc, wherein the gas is heated and expands into a plasma jet, for directing the plasma jet toward the member for heating a portion of the member so as to correct the imperfection;

a quenching head for quenching the heated portion of the member; and a carriage for moving the quenching head longitudinally along the member, and for moving the quenching head between a quenching position and a retracted position.

4. The apparatus according to claim 3 wherein the carriage also moves the plasma arc torch longitudinally along the member between a heating position and a retracted position; and wherein the carriage moves the quenching head to the retracted position when the plasma arc torch is in a heating position, and moves the plasma arc torch to the retracted position when the quenching head is in the quenching position.

5. An apparatus for geometrically modifying a member having a dimensional imperfection, the apparatus comprising in combination:

an imperfection detector for detecting the general location of the imperfection;

a plasma arc torch having an arc extending between electrodes and gas flowing past the arc, wherein the gas is heated and expands into a plasma jet, for directing the plasma jet toward the member for heating a portion of the member so as to correct the imperfection; and a carriage for moving the plasma arc torch and the imperfection detector longitudinally and in unison along the member.

6. An apparatus for geometrically modifying a member having a dimensional imperfection, the apparatus comprising in combination:

an imperfection detector for detecting the general location of the imperfection;

a deforming device for deforming a portion of the member so as to correct the imperfection;

an automated controller for automatically controlling the deforming device by receiving data from the imperfection detector, processing the data from the imperfection detector based on pre-existing data obtained from operations of the apparatus on other members, and sending control signals based on the processed data to the deforming device to control the amount of deformation; and wherein the member is tubular and has a bore, and wherein the imperfection detector inserts into the bore and further comprises:

a mandrel having a diameter smaller than the bore of the member to allow insertion into the bore;

a centralizer for centering the mandrel within the member; and a probe mounted to the mandrel for measuring concentricity of the bore of the member by comparing the distances from the centerline of the member to adjacent portions of an interior surface of the bore.

7. An apparatus for providing a desired shape for a member, the apparatus comprising in combination:

a measuring instrument for measuring at least a portion of the shape of the member;

a plasma arc torch having an arc extending between electrodes and gas flowing past the arc, wherein the gas is heated and expands into a plasma jet directed toward a portion of the member;

a quenching head for quenching the heated portion of the member, wherein the heating and subsequent quenching of the portion of the member at various locations on the member achieves the desired shape; and an automated controller for receiving data from the measuring instrument, processing the data from the measuring instrument based on pre-existing data obtained from operations of the apparatus on other members, and sending control signals based on the processed data to the plasma arc torch and quenching head to control the location of the plasma arc torch and quenching head and to control the amount of heating and quenching.

8. An apparatus for providing a desired shape for a member, the apparatus comprising in combination:

a measuring instrument for measuring at least a portion of the shape of the member;

a plasma arc torch having an arc extending between electrodes and gas flowing past the arc, wherein the gas is heated and expands into a plasma jet directed toward a portion of the member;

a quenching head for quenching the heated portion of the member, wherein the heating and subsequent quenching of the portion of the member at various locations on the member achieves the desired shape;

an automated controller for receiving data from the measuring instrument, processing the data from the measuring instrument based on pre-existing data, and sending control signals based on the processed data to the plasma arc torch and quenching head to control the location of the plasma arc torch and quenching head and to control the amount of heating and quenching;

a heat positioner for moving the plasma arc torch between a heating position and a retracted position; and a quenching positioner for moving the quenching head between a quenching position and a retracted position, wherein when the plasma arc torch is in the heating position, the quenching head is in the retracted position, and when the quenching head is in the quenching position, the plasma arc torch is in the retracted position.

9. An apparatus for providing a desired shape for a tubular member having a bore, the apparatus comprising in combination:

a measuring instrument that inserts into the bore for measuring at least a portion of the shape of the member;

a plasma arc torch having an arc extending between electrodes and gas flowing past the arc, wherein the gas is heated and expands into a plasma jet directed toward a portion of the member;

a quenching head for quenching the heated portion of the member, wherein the heating and subsequent quenching of the portion of the member at various locations on the member achieves the desired shape;

an automated controller for receiving data from the measuring instrument, processing the data from the measuring instrument based on pre-existing data, and sending control signals based on the processed data to the plasma arc torch and quenching head to control the location of the plasma arc torch and quenching head and to control the amount of heating and quenching; and wherein the measuring instrument comprises:

a mandrel having a diameter smaller than the bore of the tubular member to allow insertion into the bore;

a centralizer for centering the mandrel within the tubular member; and a probe mounted to the mandrel for measuring straightness of the bore of the tubular member by comparing the distances from the centerline of the tubular member to adjacent portions of an interior surface of the bore.

10. An apparatus for straightening a tubular member having a bore, comprising in combination:

a measuring instrument which is inserted into the bore for measuring the shape of the bore;

a rotary drive head for causing rotational movement of the tubular member relative to the measuring instrument;

a measuring instrument positioner for causing relative longitudinal movement between the measuring instrument and the tubular member;

a plasma arc torch having an arc extending between electrodes and having gas flowing past the arc, wherein the gas is heated and expands into a plasma jet directed toward the tubular member for heating a portion of the tubular member at various locations;

a quenching head for quenching the heated portion of the tubular member, wherein the heating and subsequent quenching of the portion of the tubular member straightens the tubular member;

a carriage assembly for moving the plasma arc torch longitudinally along the member; and an automated controller for (a) sending control signals to control the relative movement between the measuring instrument and the tubular member;

(b) receiving data from the measuring instrument;

(c) processing the data from the measuring instrument based on pre-existing data in a database; and (d) sending control signals based on the processed data to the plasma arc torch and the quenching head to control the locations of the plasma arc torch and the quenching head and the amount of heating and quenching.

11. The apparatus according to claim 10 wherein the measuring instrument comprises:

a mandrel having a body with an outer diameter smaller than an inner diameter of the tubular member;

a centralizer connected to the mandrel for centering the mandrel within the tubular member while allowing relative rotational movement between the mandrel and the tubular member, the centralizer having an outer diameter substantially equal to the inner diameter of the tubular member when located within the tubular member; and a probe protruding outwardly from the body of the mandrel for measuring the inner diameter of the tubular member and sending a corresponding signal to the controller, the probe being biased outwardly toward the inner diameter of the tubular member.

12. The apparatus according to claim 10 wherein the plasma arc torch includes a gas containment housing connected to the plasma arc torch and extending between the plasma arc torch and the tubular member, wherein a gas shield is created between the portion of the wall of the tubular member being heated and an exterior of the housing.

13. The apparatus according to claim 10 wherein the quenching head comprises a spray head for directing quenching fluid toward the heated portion of the tubular member.

14. The apparatus according to claim 10 wherein the quenching head comprises:

a spray head for directing quenching fluid toward the heated portion of the tubular member;

a quenching fluid containment housing connected to the spray head and extending between the spray head and the tubular member for containing the quenching fluid ejected from the spray head; and a vacuum source connected to the quenching fluid containment housing for removing, from the quenching fluid containment housing, the quenching fluid ejected from the spray head.

15. The apparatus according to claim 10 wherein the carriage assembly comprises:

a track extending parallel to the tubular member;

a carriage slidingly engaged to the track for moving longitudinally along the track;

a carriage positioner for selectively moving the carriage along the track;

a plasma arc positioner connected to the carriage for selectively positioning the plasma arc torch over the imperfection and selectively moving the plasma arc torch away from the imperfection upon receiving an appropriate signal from the controller; and a quenching head positioner connected to the carriage for selectively positioning the quenching head over the imperfection upon receiving an appropriate signal from the controller.

16. The apparatus according to claim 10 further comprising a reciprocating mechanism for reciprocating the plasma arc torch a short distance longitudinally along the tubular member while the plasma arc torch is heating the tubular member.

17. The apparatus according to claim 10 wherein the controller receives data from the measuring instrument after straightening the tubular member and adds such data to the database for future use by the controller.

* * * * *